US011454381B1

(12) United States Patent
Prosch

(10) Patent No.: US 11,454,381 B1
(45) Date of Patent: Sep. 27, 2022

(54) LUMINAIRE CONNECTION SYSTEMS

(71) Applicant: LMPG Inc., Surrey (CA)

(72) Inventor: Aaron Prosch, Burnaby (CA)

(73) Assignee: LMPG Inc., Surrey (CA)

( * ) Notice: Subject to any disclaimer, the term of this patent is extended or adjusted under 35 U.S.C. 154(b) by 0 days.

(21) Appl. No.: 17/245,543

(22) Filed: Apr. 30, 2021

(51) Int. Cl.
*F21V 21/005* (2006.01)
*F21V 17/10* (2006.01)
*F21V 15/015* (2006.01)

(52) U.S. Cl.
CPC ..... *F21V 21/005* (2013.01); *F21V 15/015* (2013.01); *F21V 17/104* (2013.01)

(58) Field of Classification Search
CPC ..... F21V 21/005; F21V 21/35; F21V 17/104; F21V 19/0085; F21V 15/015
See application file for complete search history.

(56) References Cited

U.S. PATENT DOCUMENTS 5,282,600 A * 2/1994 Weiss ..... F21V 21/005 362/404
6,530,674 B2 * 3/2003 Grierson ..... F21V 21/005 362/225
9,423,116 B2 * 8/2016 Sieberth ..... F21S 4/28
9,541,266 B2 * 1/2017 Bolscher ..... F21S 2/005
9,995,466 B2 * 6/2018 SanFacon ..... F21V 17/005

* cited by examiner

*Primary Examiner* — Leah Simone Macchiarolo
(74) *Attorney, Agent, or Firm* — Oyen Wiggs Green & Mutala LLP

(57) ABSTRACT

A system for connecting luminaires is provided. The system includes: a first luminaire comprising a receiving portion angled proximally upward and comprising a catch; a second luminaire comprising an arm moveable between a raised position and a lowered position, the arm comprising a bearing portion angled distally upward, the bearing portion comprising a threaded opening; and a first threaded fastener comprising a head and a threaded shank for threading engagement with the threaded opening of the second luminaire, the head having a diameter greater than a width of the catch of the first luminaire, and the threaded shank having a diameter smaller than the width of the catch of the first luminaire.

15 Claims, 5 Drawing Sheets

LUMINAIRE CONNECTION SYSTEMS

TECHNICAL FIELD

This invention relates to luminaires, and in particular to systems for connecting luminaires together.

BACKGROUND

Spatial and design considerations can require two or more luminaires to be connected together in certain lighting environments. Systems for effectively connecting luminaires are desirable.

SUMMARY

The following embodiments and aspects thereof are described and illustrated in conjunction with systems, tools and methods which are meant to be exemplary and illustrative, not limiting in scope. In various embodiments, one or more of the above-described problems have been reduced or eliminated, while other embodiments are directed to other improvements.

One aspect of the invention provides a system for connecting luminaires. The system includes: a first luminaire comprising a receiving portion angled proximally upward and comprising a catch; a second luminaire comprising an arm moveable between a raised position and a lowered position, the arm comprising a bearing portion angled distally upward, the bearing portion comprising a threaded opening; and a first threaded fastener comprising a head and a threaded shank for threading engagement with the threaded opening of the second luminaire, the head having a diameter greater than a width of the catch of the first luminaire, and the threaded shank having a diameter smaller than the width of the catch of the first luminaire.

In an initial position when the first luminaire and the second luminaire are aligned and separated by an initial distance, the catch of the first luminaire and the threaded opening of the second luminaire are alignable, the arm of the second luminaire is positionable in the lowered position, and the first threaded fastener is engageable with the threaded opening of the second luminaire in an untightened position.

In intermediate positions when the first luminaire and the second luminaire are aligned and separated by intermediate distances progressively shorter than the initial distance, the arm of the second luminaire is raised from the lowered position to the raised position as the head of the first threaded fastener abuts a distal face of the receiving portion of the first luminaire and slides diagonally upward the catch of the first luminaire, and subsequently the arm of the second luminaire is lowered from the raised position to the lowered position by gravity after the head of the first threaded fastener slides over a top edge of the catch of the first luminaire.

In a final position when the first luminaire and the second luminaire are aligned and in contact, the proximal angling of the receiving portion of the first luminaire corresponds to the distal angling of the bearing portion of the arm of the second luminaire whereby the arm of the second luminaire bears flatly against the receiving portion of the first luminaire, and the first threaded fastener is engageable with the threaded opening of the second luminaire in a tightened position, with the receiving portion of the first luminaire clamped between the head of the first threaded fastener and the bearing portion of the arm of the second luminaire, to tighten connection between the first luminaire and the second luminaire.

The second luminaire may comprise a receiving portion angled proximally upward and comprising a catch. The first luminaire may comprise an arm moveable between a raised position and a lowered position, the arm comprising a bearing portion angled distally upward, the bearing portion comprising a threaded opening. The second threaded fastener may comprise a head and a threaded shank for threading engagement with the threaded opening of the first luminaire, the head having a diameter greater than a width of the catch of the first luminaire, and the threaded shank having a diameter smaller than the width of the catch of the first luminaire.

In an initial position when the first luminaire and the second luminaire are aligned and separated by an initial distance, the catch of the second luminaire and the threaded opening of the first luminaire are alignable, the arm of the first luminaire is positionable in the lowered position, and the second threaded fastener is engageable with the threaded opening of the first luminaire in an untightened position.

In intermediate positions when the first luminaire and the second luminaire are aligned and separated by intermediate distances progressively shorter than the initial distance, the arm of the first luminaire is raised from the lowered position to the raised position as the head of the second threaded fastener abuts a distal face of the receiving portion of the second luminaire and slides diagonally upward the catch of the second luminaire, and subsequently the arm of the first luminaire is lowered from the raised position to the lowered position by gravity after the head of the second threaded fastener slides over a top edge of the catch of the second luminaire.

In a final position when the first luminaire and the second luminaire are aligned and in contact, the proximal angling of the receiving portion of the second luminaire corresponds to the distal angling of the bearing portion of the arm of the first luminaire whereby the arm of the first luminaire bears flatly against the receiving portion of the second luminaire, and the second threaded fastener is engageable with the threaded opening of the first luminaire in a tightened position, with the receiving portion of the second luminaire clamped between the head of the second threaded fastener and the bearing portion of the arm of the first luminaire, to tighten connection between the first luminaire and the second luminaire.

The catch of each of the receiving portions of the first luminaire and the second luminaire may comprise a chamfered slot.

Each of the first luminaire and the second luminaire may comprise a plate that comprises the corresponding receiving portions.

Respective arms of the first luminaire and the second luminaire may be pivotally connected to the respective plates of the first luminaire and the second luminaire by slot and key attachment, the pivotal connection enabling the movement of the arms between the raised position and the lowered position.

Upward proximal angling of the receiving portion of the first luminaire and the second luminaire, and the upward distal angling of the bearing portion of the arms of the first luminaire and the second luminaire, may each defined by an angle from the horizontal of about 45 degrees to 75 degrees, or about 60 degrees.

The arm of the first luminaire the arm of the second luminaire may be adjacent and extend in opposite directions.

The catch of the first luminaire may comprise a chamfered slot.

The second luminaire may comprise a plate, wherein the arm of the second luminaire is pivotally connected to the plate by slot and key attachment, the pivotal connection enabling the movement of the arm between the raised position and the lowered position.

The upward proximal angling of the receiving portion of the first luminaire, and the upward distal angling of the bearing portion of the arm of the second luminaire, may each defined by an angle from the horizontal of about 45 degrees to 75 degrees or about 60 degrees.

The system may include first and second elongated strips, wherein the first elongated strip is disposable in a slot in a sidewall of the first luminaire and engageable with a corresponding slot in a sidewall of the second luminaire, and the second elongated strip is disposable in a slot in the sidewall of the first luminaire and engageable with a corresponding slot in the sidewall of the second luminaire.

Another aspect of the invention provides a method of connecting luminaires. The method includes the steps of:

a. providing a system as described herein;
b. positioning the first luminaire and the second luminaire in the initial position, comprising:
   i. aligning the catch of the first luminaire and the threaded opening of the second luminaire to align the first luminaire and the second luminaire;
   ii. positioning the arm of the second luminaire in the lowered position; and
   iii. engaging the first threaded fastener with the threaded opening of the second luminaire in the untightened position;
c. bringing the first luminaire and the second luminaire closer together into the intermediate positions, comprising:
   i. allowing the arm of the second luminaire to be raised from the lowered position to the raised position as the head of the first threaded fastener abuts a distal face of the receiving portion of the first luminaire and slides diagonally upward the catch of the first luminaire; and
   ii. allowing the arm of the second luminaire to be lowered from the raised position to the lowered position by gravity after the head of the first threaded fastener slides over a top edge of the catch of the first luminaire; and
d. bringing the first luminaire and the second luminaire into contact with each other in the final position, comprising:
   i. allowing the arm of the second luminaire to bear flatly against the receiving portion of the first luminaire; and
   ii. engaging the first threaded fastener with the threaded opening of the second luminaire in the tightened position, with the receiving portion of the first luminaire clamped between the head of the first threaded fastener and the bearing portion of the arm of the second luminaire, to tighten connection between the first luminaire and the second luminaire.

Another aspect of the invention provides a method of connecting luminaires. The method includes the steps of:

a. providing a system as described herein;
b. positioning the first luminaire and the second luminaire in the initial position, comprising:
   i. simultaneously aligning the catch of the first luminaire and the threaded opening of the second luminaire, and aligning the catch of the second luminaire and the threaded opening of the first luminaire, to align the first luminaire and the second luminaire;
   ii. positioning the arms of the first luminaire and the second luminaire in the lowered position;
   iii. engaging the first threaded fastener with the threaded opening of the second luminaire in the untightened position; and
   iv. engaging the second threaded fastener with the threaded opening of the first luminaire in the untightened position;
c. bringing the first luminaire and the second luminaire closer together into the intermediate positions, comprising:
   i. simultaneously allowing:
      1. the arm of the second luminaire to be raised from the lowered position to the raised position as the head of the first threaded fastener abuts a distal face of the receiving portion of the first luminaire and slides diagonally upward the catch of the first luminaire; and
      2. the arm of the first luminaire to be raised from the lowered position to the raised position as the head of the second threaded fastener abuts a distal face of the receiving portion of the second luminaire and slides diagonally upward the catch of the second luminaire;\
   ii. simultaneously allowing:
      1. the arm of the second luminaire to be lowered from the raised position to the lowered position by gravity after the head of the first threaded fastener slides over a top edge of the catch of the first luminaire; and
      2. the arm of the first luminaire to be lowered from the raised position to the lowered position by gravity after the head of the second threaded fastener slides over a top edge of the catch of the second luminaire;
d. bringing the first luminaire and the second luminaire into contact with each other in the final position, comprising:
   i. simultaneously allowing:
      1. the arm of the second luminaire to bear flatly against the receiving portion of the first luminaire; and
      2. the arm of the first luminaire to bear flatly against the receiving portion of the second luminaire; and
   ii. to tighten connection between the first luminaire and the second luminaire:
      1. engaging the first threaded fastener with the threaded opening of the second luminaire in the tightened position, with the receiving portion of the first luminaire clamped between the head of the first threaded fastener and the bearing portion of the arm of the second luminaire; and
      2. engaging the second threaded fastener with the threaded opening of the first luminaire in the tightened position, with the receiving portion of the second luminaire clamped between the head of the second threaded fastener and the bearing portion of the arm of the first luminaire.

In addition to the exemplary aspects and embodiments described above, further aspects and embodiments will become apparent by reference to the drawings and by study of the following detailed descriptions.

BRIEF DESCRIPTION OF DRAWINGS

The accompanying drawings illustrate non-limiting example embodiments of the invention.

DESCRIPTION

Figure 1A:
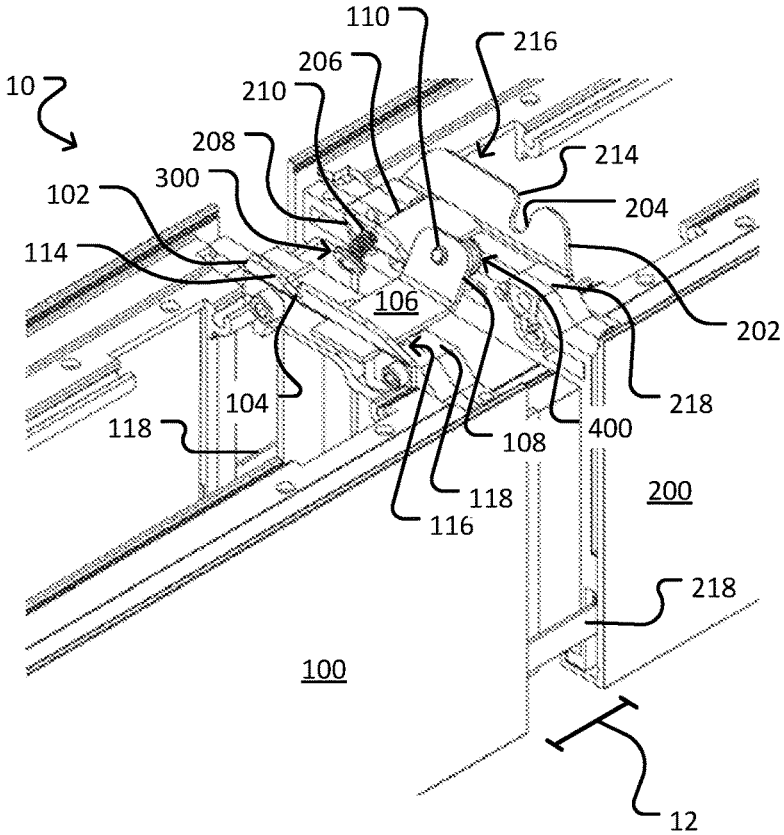
FIG. 1A is a partial isometric top view of a luminaire connection system according to an embodiment, showing the system in an initial position.

Throughout the following description, specific details are set forth in order to provide a more thorough understanding of the invention. However, the invention may be practiced without these particulars. In other instances, well known elements have not been shown or described in detail to avoid unnecessarily obscuring the invention. Accordingly, the specification and drawings are to be regarded in an illustrative, rather than a restrictive, sense.

This invention relates to luminaires, and in particular to systems for connecting two luminaires together. Embodiments of the invention of exemplary commercial application are systems for end-to-end connection of elongated, channel-shaped luminaires. Examples of elongated, channel-shaped luminaires include the luminaires sold under the name PROFILE™ by Fluxwerx Illumination, of Surrey, British Columbia. Embodiments of the invention are also applicable to connecting luminaires of other shapes and in other configurations where a secure and discreet connection between luminaires, with connection components confined within relatively limited internal spaces of the luminaires, is sought; non-limiting examples include luminaires with curved sidewalls when viewed from above and below; and non-channel-shaped narrow luminaires such as the luminaires sold under the name VIEW™ by Fluxwerx Illumination.

Aspects of the invention relate to systems comprising . . .

The terms "proximal" and "proximally" as used herein refers to a direction toward a midpoint of a luminaire. The terms "distal" and "distally" as used herein refers to a direction away from a midpoint of a luminaire.

FIGS. 1A to 4B show a system 10 for connecting elongated channel-shaped luminaires 100 and 200 together according to an embodiment.

In the illustrated embodiment the connecting features of system 10 are located along the tops of the ends of luminaires 100 and 200 so that the connecting features are not visible, or at least mostly not visible, to users of the workspace below once luminaires 100 and 200 are installed. FIGS. 3A, 3B, 4A and 4B show a clean connection of the sidewalls of luminaires 100 and 200.

Luminaire 100 has a receiving portion 102 along the top of, and adjacent to, a connecting end 101 of luminaire 100. As best shown in FIG. 1B, receiving portion 102 is set back from connecting end 101 of luminaire 100. In other embodiments receiving portion 102 may be closer to, or set back further from, or disposed at, connecting end 101. As best shown in FIG. 1B, receiving portion 102 extends proximally upwardly at an angle 16 from the horizontal.

Receiving portion 102 has a distal face 112 facing the direction of luminaire 200. At least a portion of the top edge of receiving portion 102 is defined by a catch 104. Top edge 114 of catch 104 is chamfered.

Luminaire 100 also has an arm 106 along the top of, and extending distally horizontally from, connecting end 101 of luminaire 100. As best shown in FIG. 1B, arm 106 extends past connecting end 101 of luminaire 100. In other embodiments arm 106 may extend further past, or extend less from, or extend up to, connecting end 101. As best shown in FIG. 1B, the distal end of arm 106 defines a bearing portion 108 that extends distally upwardly at an angle 16 from the horizontal and the rest of arm 106.

Bearing portion 108 of arm 106 has a threaded opening for receiving a first threaded fastener 300. First threaded fastener 300 may for example be a machine screw. Fastener 300 has a head 302 defining a head diameter 306, and a threaded shank 304 defining a shank diameter 308. Catch 104 of receiving portion 102 is dimensioned to wider than shank diameter 308 but narrower than head diameter 306.

Figure 1B:
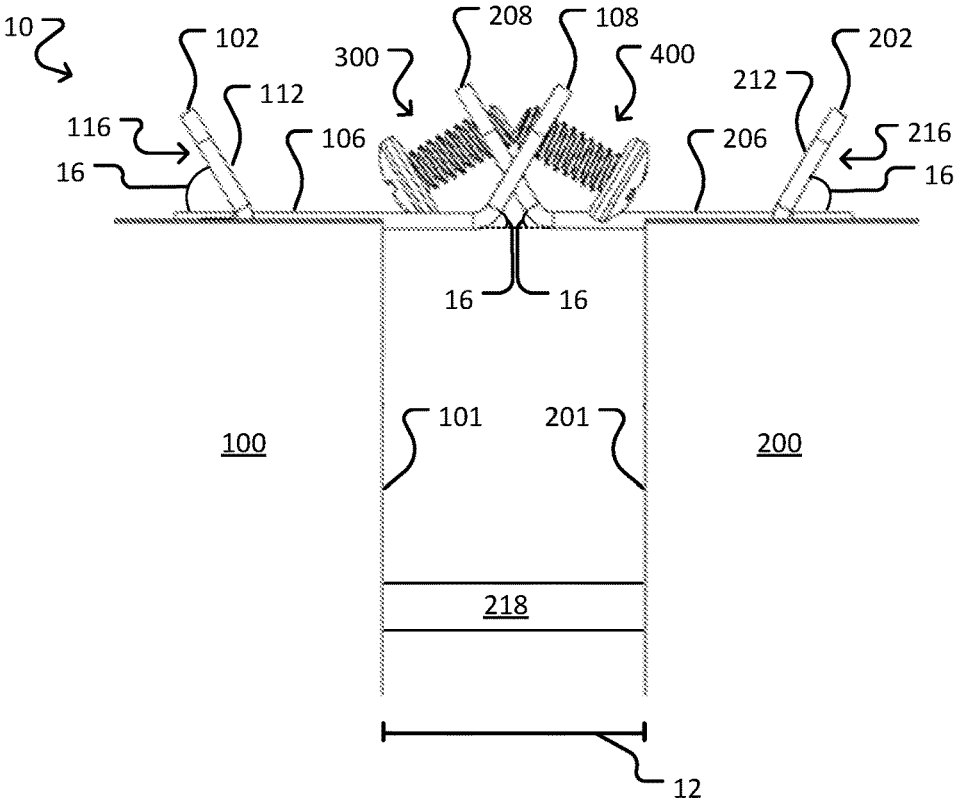
FIG. 1B is a partial side view of the embodiment of FIG. 1, showing the system in an initial position.
Figure 2A:
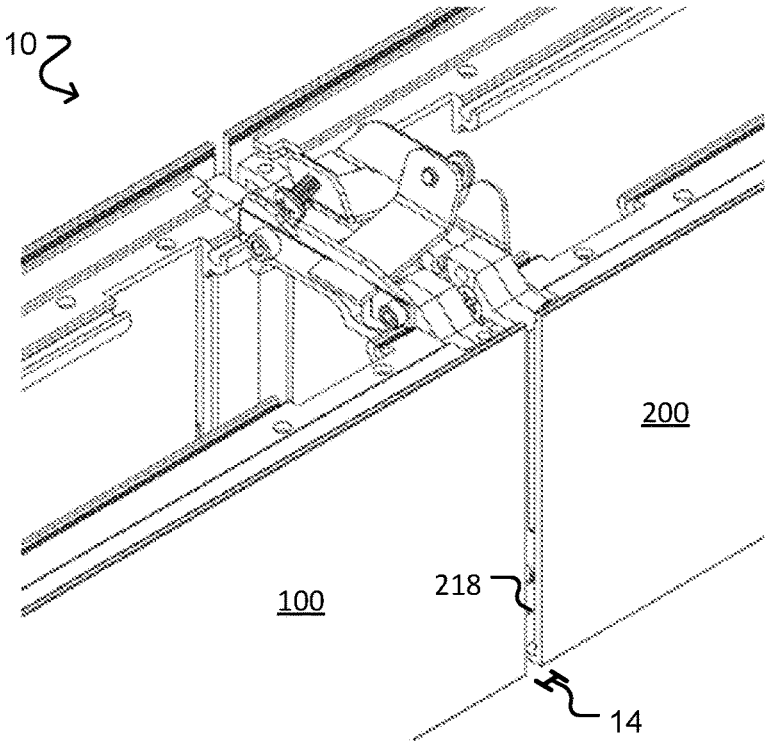
FIG. 2A is a partial isometric top view of the embodiment of FIG. 1, showing the system in an intermediate position.
Figure 2B:
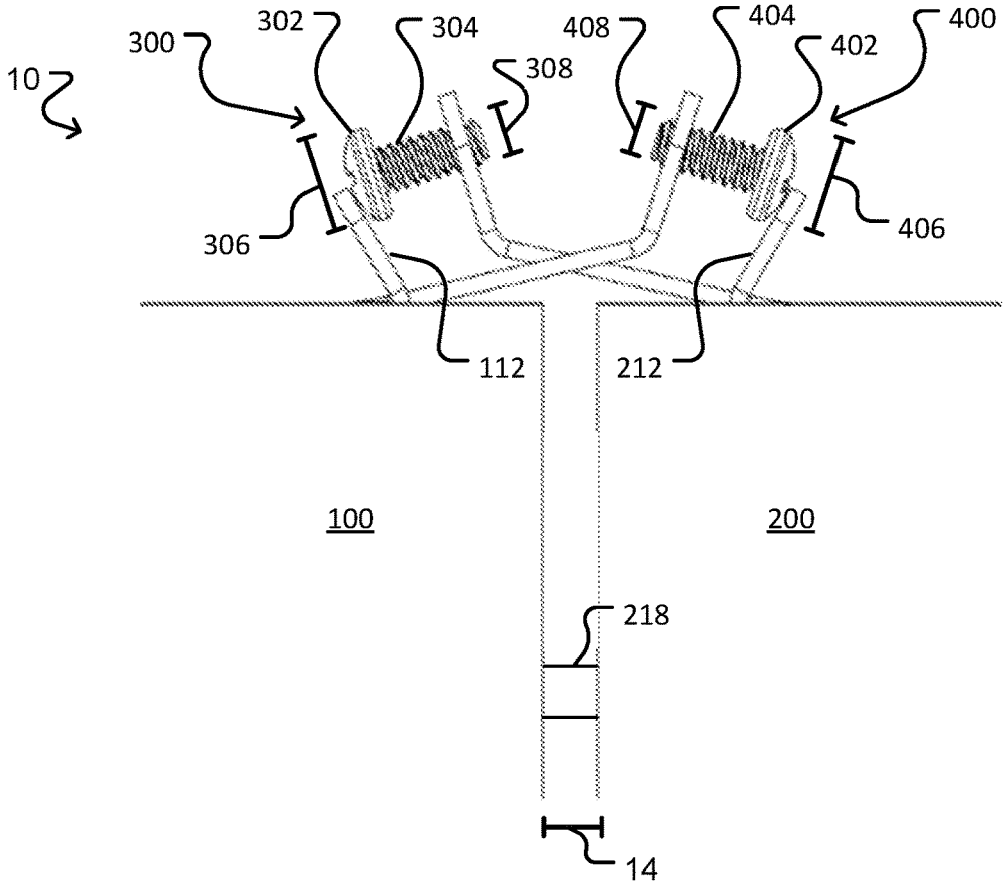
FIG. 2B is a partial side view of the embodiment of FIG. 1, showing the system in an intermediate position.

Plate 116 of luminaire 100 receives arm 106 by slot and key connection, permitting arm 106 to pivot between a lowered position (see FIGS. 1B, 3B and 4B) and a raised position (see FIG. 2B). In other embodiments, arm 106 may be connected to luminaire 100 in any other suitable manner that permits pivotal movement between the lowered position and the raised position.

A section of plate 116 laterally adjacent to arm 106 defines receiving portion 102. In other embodiments, receiving portion 102 is disposed laterally adjacently to, but may be a separate component from, plate 116 that receives arm 106.

The features of system 10 on luminaire 100 have identical counterpart features on luminaire 200, as follows.

Luminaire 200 has a receiving portion 202 along the top of, and adjacent to, a connecting end 201 of luminaire 200. As best shown in FIG. 1B, receiving portion 202 is set back from connecting end 201 of luminaire 200. In other embodiments receiving portion 202 may be closer to, or set back further from, or disposed at, connecting end 201. As best shown in FIG. 1B, receiving portion 202 extends proximally upwardly at an angle 16 from the horizontal.

Receiving portion 202 has a distal face 212 facing the direction of luminaire 100. At least a portion of the top edge of receiving portion 202 is defined by a catch 204. Top edge 214 of catch 204 is chamfered.

Luminaire 200 also has an arm 206 along the top of, and extending distally horizontally from, connecting end 201 of luminaire 200. As best shown in FIG. 1B, arm 206 extends past connecting end 201 of luminaire 200. In other embodiments arm 206 may extend further past, or extend less from, or extend up to, connecting end 201. As best shown in FIG. 1B, the distal end of arm 206 defines a bearing portion 208 that extends distally upwardly at an angle 16 from the horizontal and the rest of arm 206.

Bearing portion 208 of arm 206 has a threaded opening for receiving a second threaded fastener 400. Second threaded fastener 400 may for example be a machine screw.

Fastener 400 has a head 402 defining a head diameter 406, and a threaded shank 404 defining a shank diameter 408. Catch 204 of receiving portion 202 is dimensioned to wider than shank diameter 408 but narrower than head diameter 406.

Plate 216 of luminaire 200 receives arm 206 by slot and key connection, permitting arm 206 to pivot between a lowered position (see FIGS. 1B, 3B and 4B) and a raised position (see FIG. 2B). In other embodiments, arm 206 may be connected to luminaire 200 in any other suitable manner that permits pivotal movement between the lowered position and the raised position.

A section of plate 216 laterally adjacent to arm 206 defines receiving portion 202. In other embodiments, receiving portion 202 is disposed laterally adjacently to, but may be a separate component from, plate 216 that receives arm 206.

In operation, system 10 may be used in conjunction with a connection system such as that described in U.S. Pat. No. 10,077,891 to Fortin, or other such system that provides initial guidance of luminaire 100 and luminaire 200 toward each other. In other embodiments system 10 may be used as the sole connection system.

FIGS. 1A and 1B show system 10 in an initial position where luminaire 100 and luminaire 200 are aligned but separated by an initial distance 12. First threaded fastener 300 is engaged in an untightened position with threaded opening 210 of bearing portion 208 of arm 206. Second threaded fastener 400 is engaged in an untightened position with threaded opening 110 of bearing portion 108 of arm 106. Both arm 106 and arm 206 are in the lowered position, resting horizontally on respective crossbars 118, 218 of luminaires 100, 200.

FIGS. 2A and 2B show system 10 in one of many intermediate positions where luminaire 100 and luminaire 200 have been brought together to an intermediate distance 14 shorter than initial distance 12. As the distance between luminaires 100, 200 shortens, head 302 of first threaded fastener 300 approaches, abuts, and is then forced to slide up distal receiving portion 112 of first luminaire 100 causing arm 206 to pivot upwardly to a raised position, and simultaneously head 402 of second threaded fastener 400 approaches, abuts, and is then forced to slide up distal receiving portion 212 of second luminaire 200 causing arm 106 to pivot upwardly to a raised position.

Figure 3A:
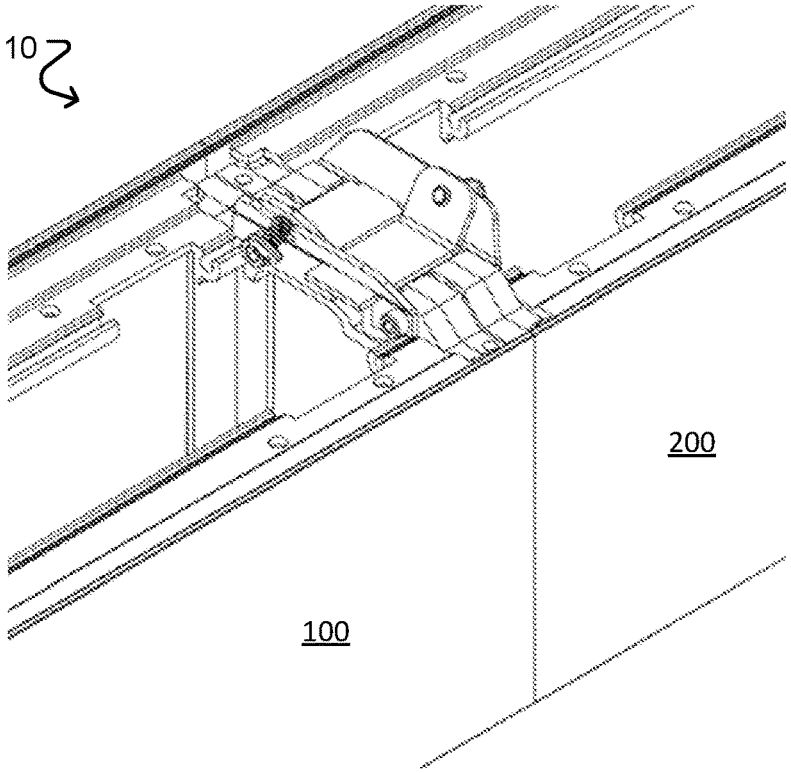
FIG. 3A is a partial isometric top view of the embodiment of FIG. 1, showing the system in a final position with the fasteners untightened.
Figure 3B:
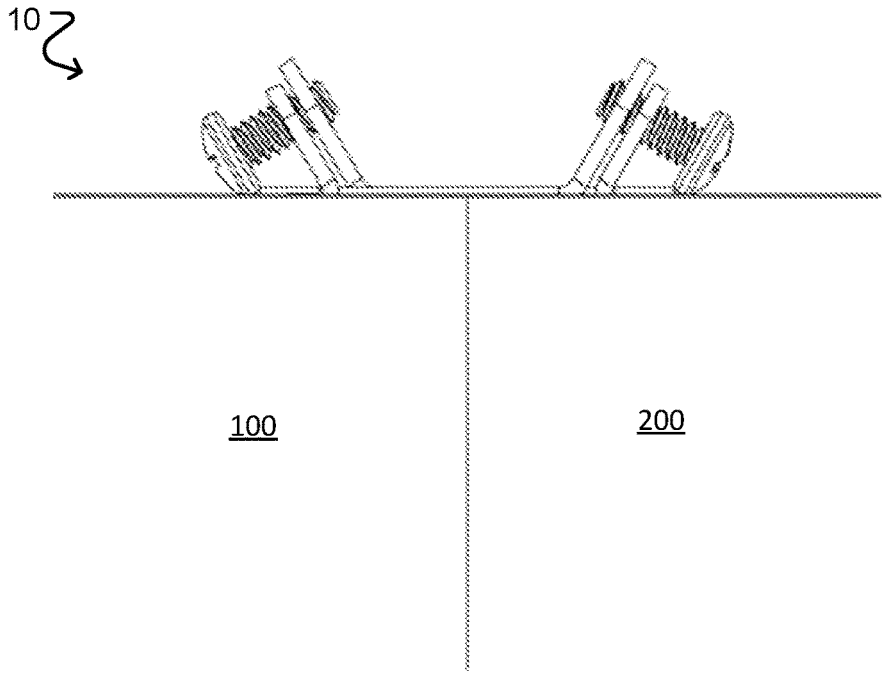
FIG. 3B is a partial side view of the embodiment of FIG. 1, showing the system in a final position with the fasteners untightened.

FIGS. 2A and 2B show system 10 where head 302 is sliding up distal receiving portion 112 and head 402 is sliding up distal receiving portion 212. As luminaires 100, 200 are brought even closer together to the point of joining, head 302 slides up and over top edge 114, and then first threaded fastener 300 drops by gravity until shank 304 is fully received in catch 104; simultaneously, head 402 slides up and over top edge 214, and then second threaded fastener 400 drops by gravity until shank 404 is fully received in catch 204. FIGS. 3A and 3B show this final position, where bearing portion 108 of arm 106 of first luminaire 100 bears flatly against distal face 212 of receiving portion 202 of second luminaire 200, and simultaneously bearing portion 208 of arm 206 of second luminaire 200 bears flatly against distal face 112 of receiving portion 102 of first luminaire 100. Bearing portions 108, 208 can bear flatly against distal faces 212, 112 because of common angle 16. In some embodiments angle 16 may range from about 45 degrees to about 75 degrees from the horizontal, or about 60 degrees from the horizontal.

Figure 4A:
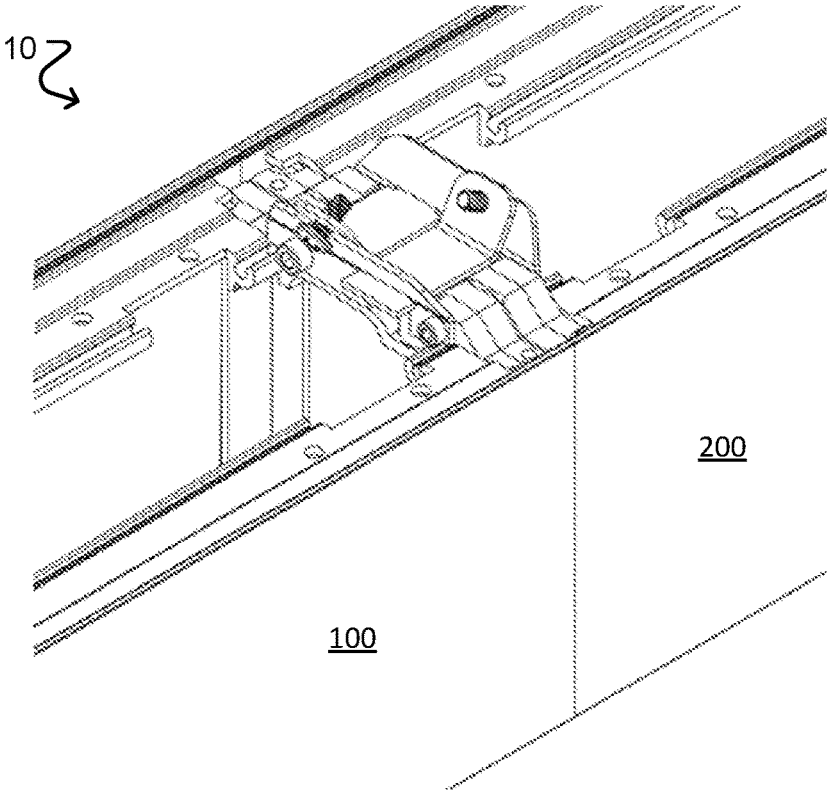
FIG. 4A is a partial isometric top view of the embodiment of FIG. 1, showing the system in a final position with the fasteners tightened.
Figure 4B:
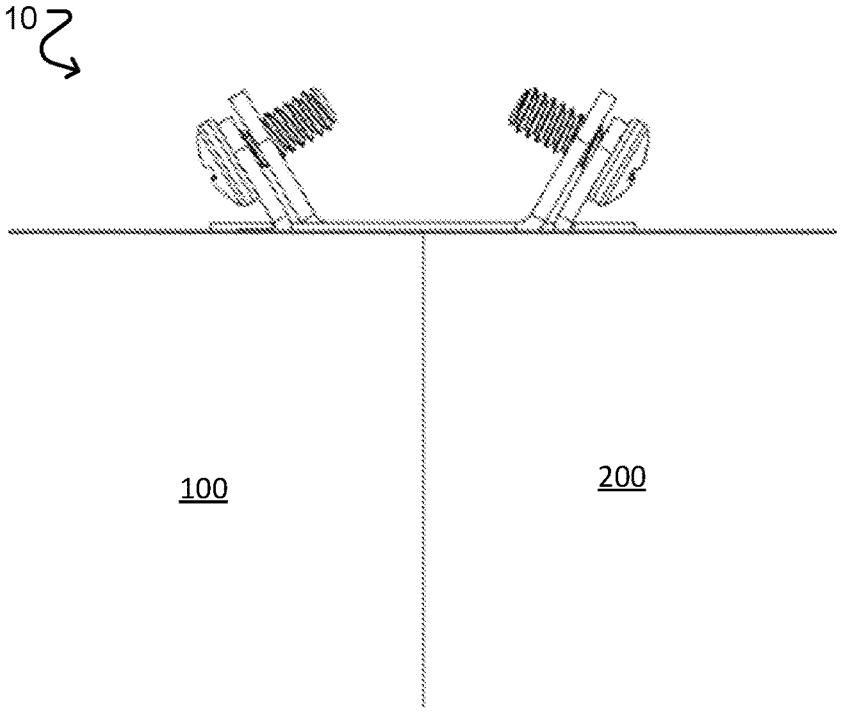
FIG. 4B is a partial side view of the embodiment of FIG. 1, showing the system in a final position with the fasteners tightened.

FIGS. 4A and 4B also show system 10 in the final position, except now with first threaded fastener 300 and second threaded fastener 400 tightened. Receiving portion 102 of first luminaire 200 is clamped between head 302 of first threaded fastener 300 and bearing portion 208 of arm 206 of second luminaire 200. Receiving portion 202 of second luminaire 200 is clamped between head 402 of second threaded fastener 400 and bearing portion 108 of arm 106 of first luminaire 100. The term "clamped" as used herein does not necessarily meant that receiving portion is both abutted by the head on one side and the bearing portion on the other side. For example, as shown in FIG. 4B, there may be small gap between the distal face of the receiving portion and the bearing portion of the arm even after the fasteners are in the tightened position. At minimum, however, the term "clamped" as used herein means that the head of the fastener bears against a proximal face of the receiving portion to securely connect the arm to the receiving portion, and thereby securely connect the two luminaires together.

Figure 5:
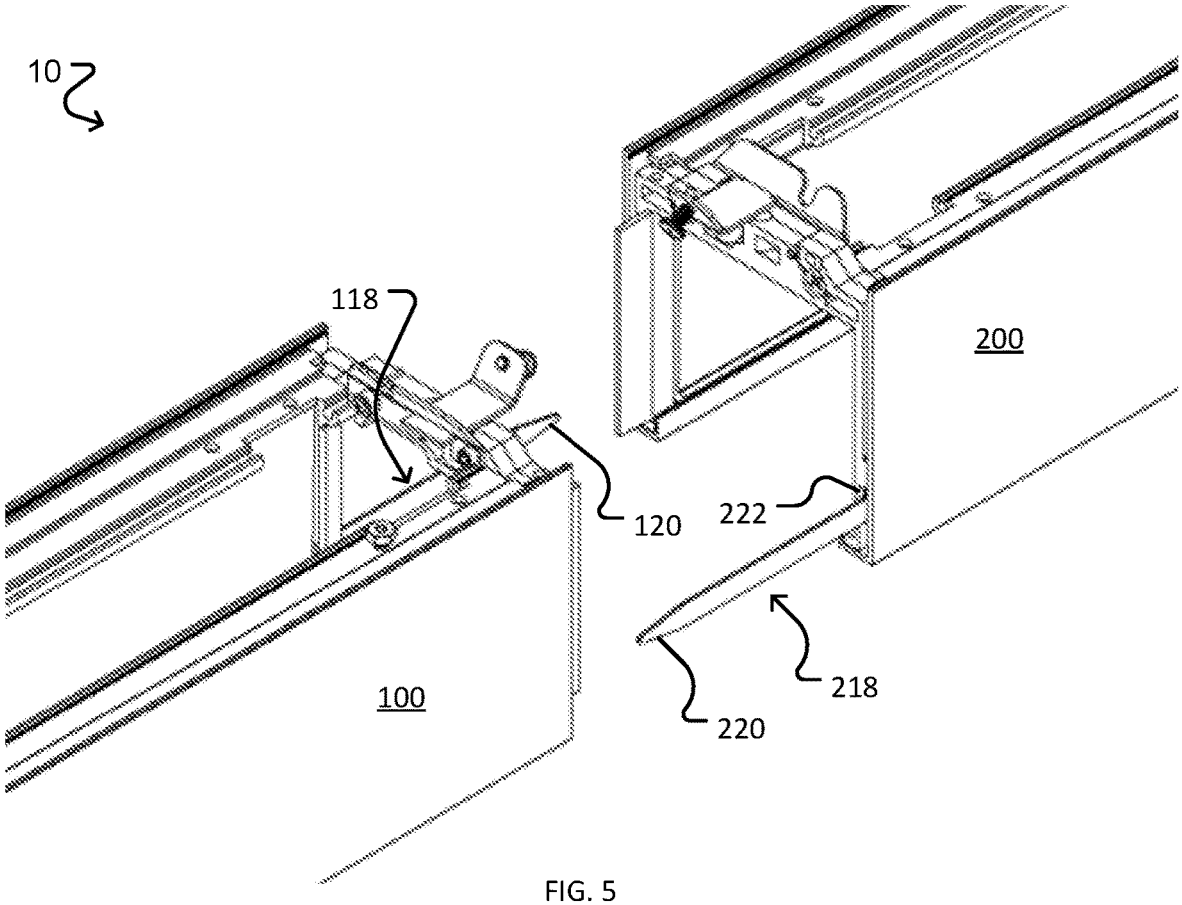
FIG. 5 is a partial isometric top view of the embodiment of FIG. 1, showing the system in a separated position.
Figure 6:
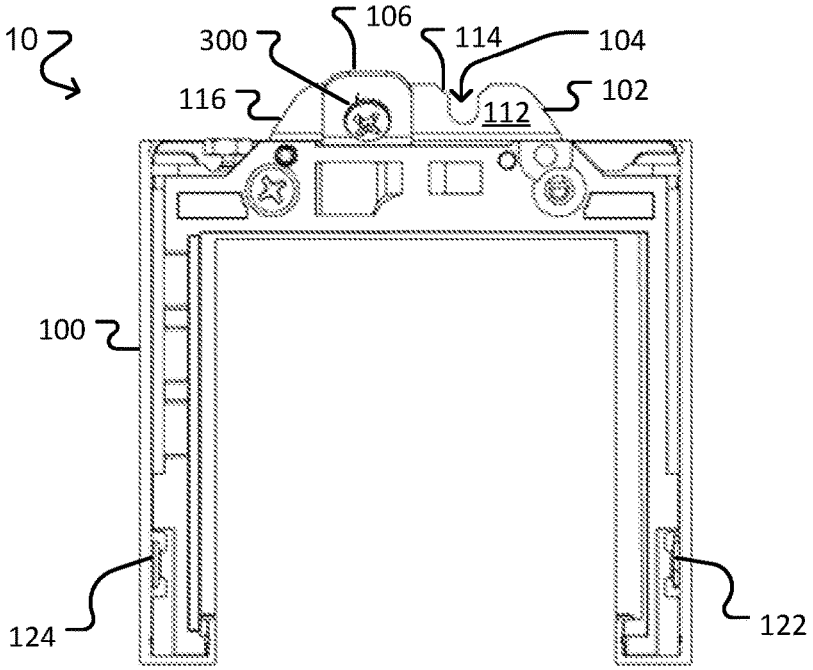
FIG. 6 is an end view of a first luminaire of the embodiment of FIG. 1.

FIG. 5 shows system 10 in a separated position, i.e., the position prior to the initial position shown in FIGS. 1A and 1B. Luminaires 100, 200 are aligned. In particular, alignment of elongated strip 218 disposed in slot 222 of the sidewall of luminaire 200 is aligned to be received in slot 124 of the sidewall of luminaire 100. Likewise, alignment of elongated strip 118 disposed in slot 122 of the sidewall of luminaire 100 is aligned to be received in a corresponding slot (hidden from view in FIG. 5) of the sidewall of luminaire 200. Strips 118, 218 have corresponding pointed tips 120, 220 for facilitating entry into their corresponding slots. Once at least tips 120, 220 are engaged in their corresponding slots, luminaires 100, 200 can be readily guided toward each other in an aligned manner.

Elongated strips 118, 218 are independent components and are removably disposed in corresponding slots 122, 222. This means, for example, that in some embodiments elongated strips 118, 218 may be both initially disposed in slots 122, 124 of luminaire 100, and then aligned and joined with corresponding slots of luminaire 200. In some embodiments, only one elongated strip and corresponding slot may be provided. In some embodiments, the elongated strips and corresponding slots may be absent altogether.

In some embodiments (not illustrated), two luminaires may be connected by a system similar to system 10 but with only one set of each feature. For example, a first luminaire may include a receiving portion with a catch but without an arm, and a second luminaire may include an arm with a bearing portion but without a receiving portion. The system would accordingly require only one fastener, and otherwise operate in a similar manner to system 10. In other embodiments (not illustrated), two luminaires may be connected by a system similar to system 10 but two or more sets of each feature, with a corresponding number of fasteners, and otherwise operate in a similar manner to system 10.

Where a component (e.g. catch, arm, fastener, etc.) is referred to above, unless otherwise indicated, reference to that component (including a reference to a "means") should be interpreted as including as equivalents of that component any component which performs the function of the described component (i.e. that is functionally equivalent), including components which are not structurally equivalent to the disclosed structure which performs the function in the illustrated exemplary embodiments of the invention.

While a number of exemplary aspects and embodiments have been discussed above, those of skill in the art will recognize certain modifications, permutations, additions and sub-combinations thereof. It is therefore intended that the following appended claims and claims hereafter introduced are interpreted to include all such modifications, permutations, additions and sub-combinations as are consistent with the broadest interpretation of the specification as a whole.

The invention claimed is:

1. A system for connecting luminaires, the system comprising:

a. a first luminaire comprising a receiving portion angled proximally upward and comprising a catch;

b. a second luminaire comprising an arm moveable between a raised position and a lowered position, the arm comprising a bearing portion angled distally upward, the bearing portion comprising a threaded opening;

c. a first threaded fastener comprising a head and a threaded shank for threading engagement with the threaded opening of the second luminaire, the head having a diameter greater than a width of the catch of the first luminaire, and the threaded shank having a diameter smaller than the width of the catch of the first luminaire;

wherein in an initial position when the first luminaire and the second luminaire are aligned and separated by an initial distance, the catch of the first luminaire and the threaded opening of the second luminaire are alignable, the arm of the second luminaire is positionable in the lowered position, and the first threaded fastener is engageable with the threaded opening of the second luminaire in an untightened position, wherein in intermediate positions when the first luminaire and the second luminaire are aligned and separated by intermediate distances progressively shorter than the initial distance, the arm of the second luminaire is raised from the lowered position to the raised position as the head of the first threaded fastener abuts a distal face of the receiving portion of the first luminaire and slides diagonally upward the catch of the first luminaire, and subsequently the arm of the second luminaire is lowered from the raised position to the lowered position by gravity after the head of the first threaded fastener slides over a top edge of the catch of the first luminaire, wherein in a final position when the first luminaire and the second luminaire are aligned and in contact, the proximal angling of the receiving portion of the first luminaire corresponds to the distal angling of the bearing portion of the arm of the second luminaire whereby the arm of the second luminaire bears flatly against the receiving portion of the first luminaire, and the first threaded fastener is engageable with the threaded opening of the second luminaire in a tightened position, with the receiving portion of the first luminaire clamped between the head of the first threaded fastener and the bearing portion of the arm of the second luminaire, to tighten connection between the first luminaire and the second luminaire.

2. A system according to claim 1 wherein a. the second luminaire comprises a receiving portion angled proximally upward and comprises a catch;

b. the first luminaire comprises an arm moveable between a raised position and a lowered position, the arm comprising a bearing portion angled distally upward, the bearing portion comprising a threaded opening;

c. a second threaded fastener comprising a head and a threaded shank for threading engagement with the threaded opening of the first luminaire, the head having a diameter greater than a width of the catch of the first luminaire, and the threaded shank having a diameter smaller than the width of the catch of the first luminaire;

wherein in an initial position when the first luminaire and the second luminaire are aligned and separated by an initial distance, the catch of the second luminaire and the threaded opening of the first luminaire are alignable, the arm of the first luminaire is positionable in the lowered position, and the second threaded fastener is engageable with the threaded opening of the first luminaire in an untightened position, wherein in intermediate positions when the first luminaire and the second luminaire are aligned and separated by intermediate distances progressively shorter than the initial distance, the arm of the first luminaire is raised from the lowered position to the raised position as the head of the second threaded fastener abuts a distal face of the receiving portion of the second luminaire and slides diagonally upward the catch of the second luminaire, and subsequently the arm of the first luminaire is lowered from the raised position to the lowered position by gravity after the head of the second threaded fastener slides over a top edge of the catch of the second luminaire, wherein in a final position when the first luminaire and the second luminaire are aligned and in contact, the proximal angling of the receiving portion of the second luminaire corresponds to the distal angling of the bearing portion of the arm of the first luminaire whereby the arm of the first luminaire bears flatly against the receiving portion of the second luminaire, and the second threaded fastener is engageable with the threaded opening of the first luminaire in a tightened position, with the receiving portion of the second luminaire clamped between the head of the second threaded fastener and the bearing portion of the arm of the first luminaire, to tighten connection between the first luminaire and the second luminaire.

3. A system according to claim 2 wherein the catch of each of the receiving portions of the first luminaire and the second luminaire comprises a chamfered slot.

4. A system according to claim 3 wherein each of the first luminaire and the second luminaire comprise a plate that comprises the corresponding receiving portions.

5. A system according to claim 4 wherein respective arms of the first luminaire and the second luminaire are pivotally connected to the respective plates of the first luminaire and the second luminaire by slot and key attachment, the pivotal connection enabling the movement of the arms between the raised position and the lowered position.

6. A system according to claim 5 wherein the upward proximal angling of the receiving portion of the first luminaire and the second luminaire, and the upward distal angling of the bearing portion of the arms of the first luminaire and the second luminaire, are each defined by an angle from the horizontal of about 45 degrees to 75 degrees.

7. A system according to claim 6 wherein the angle from the horizontal is about 60 degrees.

8. A system according to claim 7 wherein the arm of the first luminaire the arm of the second luminaire are adjacent and extend in opposite directions.

9. A system according to claim 2 wherein the catch of the first luminaire comprises a chamfered slot.

10. A system according to claim 9 wherein the second luminaire comprise a plate, wherein the arm of the second luminaire is pivotally connected to the plate by slot and key attachment, the pivotal connection enabling the movement of the arm between the raised position and the lowered position.

11. A system according to claim 10 wherein the upward proximal angling of the receiving portion of the first luminaire, and the upward distal angling of the bearing portion of the arm of the second luminaire, are each defined by an angle from the horizontal of about 45 degrees to 75 degrees.

12. A system according to claim 11 wherein the angle from the horizontal is about 60 degrees.

13. A system according to claim 2 further comprising first and second elongated strips, wherein the first elongated strip is disposable in a slot in a sidewall of the first luminaire and engageable with a corresponding slot in a sidewall of the second luminaire, and the second elongated strip is disposable in a slot in the sidewall of the first luminaire and engageable with a corresponding slot in the sidewall of the second luminaire.

14. A method of connecting luminaires comprising:

a. providing a system according to claim 2;

b. positioning the first luminaire and the second luminaire in the initial position, comprising:

i. simultaneously aligning the catch of the first luminaire and the threaded opening of the second luminaire, and aligning the catch of the second luminaire and the threaded opening of the first luminaire, to align the first luminaire and the second luminaire;

ii. positioning the arms of the first luminaire and the second luminaire in the lowered position;

iii. engaging the first threaded fastener with the threaded opening of the second luminaire in the untightened position; and iv. engaging the second threaded fastener with the threaded opening of the first luminaire in the untightened position;

c. bringing the first luminaire and the second luminaire closer together into the intermediate positions, comprising:

i. simultaneously allowing:

1. the arm of the second luminaire to be raised from the lowered position to the raised position as the head of the first threaded fastener abuts a distal face of the receiving portion of the first luminaire and slides diagonally upward the catch of the first luminaire; and 2. the arm of the first luminaire to be raised from the lowered position to the raised position as the head of the second threaded fastener abuts a distal face of the receiving portion of the second luminaire and slides diagonally upward the catch of the second luminaire;

ii. simultaneously allowing:

1. the arm of the second luminaire to be lowered from the raised position to the lowered position by gravity after the head of the first threaded fastener slides over a top edge of the catch of the first luminaire; and 2. the arm of the first luminaire to be lowered from the raised position to the lowered position by gravity after the head of the second threaded fastener slides over a top edge of the catch of the second luminaire;

d. bringing the first luminaire and the second luminaire into contact with each other in the final position, comprising:

i. simultaneously allowing:

1. the arm of the second luminaire to bear flatly against the receiving portion of the first luminaire; and 2. the arm of the first luminaire to bear flatly against the receiving portion of the second luminaire; and ii. to tighten connection between the first luminaire and the second luminaire:

1. engaging the first threaded fastener with the threaded opening of the second luminaire in the tightened position, with the receiving portion of the first luminaire clamped between the head of the first threaded fastener and the bearing portion of the arm of the second luminaire; and 2. engaging the second threaded fastener with the threaded opening of the first luminaire in the tightened position, with the receiving portion of the second luminaire clamped between the head of the second threaded fastener and the bearing portion of the arm of the first luminaire.

15. A method of connecting luminaires comprising:

a. providing a system according to claim 1;

b. positioning the first luminaire and the second luminaire in the initial position, comprising:

i. aligning the catch of the first luminaire and the threaded opening of the second luminaire to align the first luminaire and the second luminaire;

ii. positioning the arm of the second luminaire in the lowered position; and iii. engaging the first threaded fastener with the threaded opening of the second luminaire in the untightened position;

c. bringing the first luminaire and the second luminaire closer together into the intermediate positions, comprising:

i. allowing the arm of the second luminaire to be raised from the lowered position to the raised position as the head of the first threaded fastener abuts a distal face of the receiving portion of the first luminaire and slides diagonally upward the catch of the first luminaire; and ii. allowing the arm of the second luminaire to be lowered from the raised position to the lowered position by gravity after the head of the first threaded fastener slides over a top edge of the catch of the first luminaire; and d. bringing the first luminaire and the second luminaire into contact with each other in the final position, comprising:

i. allowing the arm of the second luminaire to bear flatly against the receiving portion of the first luminaire; and ii. engaging the first threaded fastener with the threaded opening of the second luminaire in the tightened position, with the receiving portion of the first luminaire clamped between the head of the first threaded fastener and the bearing portion of the arm of the second luminaire, to tighten connection between the first luminaire and the second luminaire.

* * * * *